US005115184A

United States Patent [19]

Arthur et al.

[11] Patent Number: 5,115,184

[45] Date of Patent: May 19, 1992

[54] COOLING SYSTEM FOR FURNACE ROOF HAVING A REMOVABLE DELTA

[75] Inventors: Mark T. Arthur, Lakewood; Frank H. Miner, Jr., North Olmsted, both of Ohio

[73] Assignee: Ucar Carbon Technology Corporation, Danbury, Conn.

[21] Appl. No.: 676,528

[22] Filed: Mar. 28, 1991

[51] Int. Cl.[5] ..... F27D 1/02

[52] U.S. Cl. ..... 373/74; 373/71; 373/72; 373/73; 373/94; 373/95

[58] Field of Search ..... 373/74, 73, 72, 71, 373/75, 76, 77, 94, 95, 96

[56] References Cited

U.S. PATENT DOCUMENTS

| | | | |
|---|---|---|---|
| 1,840,247 | 1/1932 | Northrup | 373/158 |
| 3,388,737 | 6/1968 | Buckwalter et al. | 164/283 |
| 3,429,973 | 2/1969 | Carter et al. | 13/9 |
| 3,858,861 | 1/1975 | Jernigan | 266/32 |
| 4,107,449 | 8/1978 | Sosonkin et al. | 13/35 |
| 4,197,422 | 4/1980 | Fuchs et al. | 13/32 |
| 4,216,348 | 8/1980 | Greenberger | 13/32 |
| 4,239,484 | 12/1980 | Schuster | 432/77 |
| 4,273,949 | 6/1981 | Fischer et al. | 13/35 |
| 4,332,852 | 1/1979 | Andoniev et al. | 13/32 |
| 4,345,332 | 8/1982 | Wronka | 373/74 |
| 4,443,188 | 4/1984 | Buhler | 432/233 |
| 4,494,594 | 1/1985 | Kurzinski | 164/443 |
| 4,633,480 | 12/1986 | Bleimann | 373/74 |
| 4,715,042 | 12/1987 | Heggart et al. | 373/74 |
| 4,789,991 | 12/1988 | Metelmann et al. | 373/74 |
| 4,813,055 | 3/1989 | Heggart et al. | 373/74 |
| 4,815,096 | 3/1989 | Burwell | 373/74 |
| 4,849,987 | 7/1989 | Miner et al. | 373/74 |
| 4,852,120 | 7/1989 | Udo | 373/95 |

FOREIGN PATENT DOCUMENTS

| | | |
|---|---|---|
| 1108372 | 10/1957 | Fed. Rep. of Germany . |
| 3027465 | 3/1982 | Fed. Rep. of Germany . |
| 45-29728 | 9/1970 | Japan . |
| 57-48615 | 10/1982 | Japan . |

OTHER PUBLICATIONS

Spray Tech Mold System. George Hess, Syracuse, USA, World Steel and Metalworking, vol. 7, 85/86. ,

*Primary Examiner*—Bruce A. Reynolds
*Assistant Examiner*—Tu Hoang
*Attorney, Agent, or Firm*—Cornelius F. O'Brien

[57] ABSTRACT

A cover for a vessel handling heated substances, such as a furnace, in which the cover comprises an outer segment defining an opening in which a removable inner cover segment (delta) is seated and wherein said inner cover segment comprises spaced apart walls defining an enclosed space that contains coolant spray means adapted for spraying coolant onto the wall that is closest to the interior of the vessel.

10 Claims, 3 Drawing Sheets

COOLING SYSTEM FOR FURNACE ROOF HAVING A REMOVABLE DELTA

FIELD OF THE INVENTION

The invention relates to a cover for a vessel such as a furnace in which said cover comprises an outer cover segment defining an opening in which a removable inner cover segment (delta) is mounted. The removable inner cover segment comprises a bottom wall, an upstanding wall and a top wall defining an enclosed space and wherein spray means are positioned to direct a spray of water at least against the bottom wall for cooling said bottom wall

BACKGROUND OF THE INVENTION

Prior art systems for containing molten materials, and in particular, molten metals, have relied on refractory lining or water cooling or a combination of both to protect the walls, bottom and covers of such vessels from the high temperature generated by the molten materials and off-gases. In the case of molten metals such as steel, these temperatures may be in excess of 2800° F. (1540° C.).

Refractory linings installed in such vessels are costly and have short lives, even where such linings are utilized above the melt line of the vessel. Although water has been utilized to cool the inner surfaces of these vessels (generally made from structural steel plate) it has been the usual practice to utilize closed systems in which pressurized water completely fills circulating passages within the vessel walls, roof, etc. These systems generally necessitate high volumes of water at relatively high pressures. "Hot spots" created on the inner wall by blockage of coolant water can lead to flashing of the water to steam and rupture of the containment structure. Once leakage occurs in the inner walls of the vessel, the flow of the cooling water into the molten material can lead to serious hazards such as explosions due to the water flashing to steam or other adverse reactions. These problems could create serious hazards to life and equipment. Other prior art systems which seek to alleviate such problems utilize complex, costly and difficult-to-maintain equipment which is clearly not desirable in the surrounding area and environment of steel furnaces and other molten material handling vessels.

U.S. Pat. No. 4,813,055 discloses a spray cooling system for cooling a furnace for the melting or treatment of molten metal, and particularly the roof and/or sidewall of electric-arc, plasma-arc and ladle furnaces. Specifically, spray headers and pipes supply coolant to spray nozzles distributed within a coolant space in a roof structure to spray coolant against the working plates of the roof. The coolant is quickly and effectively removed from the coolant space after it is sprayed against the working plates, thereby avoiding any potentially detrimental movement and localized collection of the coolant in the space.

It is an object of the present invention to provide a cooling system for a removable segment of a cover for a vessel that contains tubes coupled to nozzles arranged to direct a spray of coolant against the surface of the cover that is to be cooled.

It is another object of the present invention to provide a roof for a furance that has a removable delta section that is cooled by spray coolant means.

It is another object of the present invention to provide a removable delta section of a roof that employs removable spray coolant means comprising tubes coupled to nozzles that are arranged to direct a spray of coolant against a surface of the roof that is to be cooled.

It is another object of the present invention to provide a cost effective removable delta for roofs or vessels such as furnaces handling molten materials.

These and other objects of the invention will become apparent upon consideration of the following description viewed in conjunction with the drawings.

SUMMARY OF THE INVENTION

The invention relates to a vessel for handling a heated substance, said vessel having a cover comprising an outer cover defining an inner opening into which is seated a removable inner cover, said inner cover (delta) comprising a bottom wall, an upstanding wall and a top wall defining an enclosed space; spray means comprising a plurality of tubes coupled to spray nozzles disposed within said enclosed space and arranged to direct a spray of coolant from the spray nozzles onto at least the bottom wall so as to maintain a desired temperature at said bottom wall; inlet means for bringing coolant to the tubes and spray nozzles; outlet means for removing the spent coolant from the enclosed space; and said inner cover defining at least one opening by an upstanding wall so that coolant in the enclosed space is prevented from entering said opening in said inner cover.

In the preferred embodiment of the invention, an outer cover for the vessel would comprise inner and outer walls defining an enclosed space therebetween; an inlet into the space for a fluid coolant; means for spraying the coolant against the inner wall to maintain a desired temperature at the inner wall; and an outlet for removing the spent coolant. The outer cover could also have means for supplying the coolant to the tubes in the inner cover so that the coolant could be provided to the overall cover from a single source. This could be accomplished by using conventional coupling means for connecting a coolant feed tube in the outer cover to the inlet coolant tube in the inner cover. The spent coolant in the inner cover could also be fed from a tube in the inner cover to a tube in the outer cover where the spent coolant could then be discharged from the outer cover. Conventional coupling means could be used to connect the spent coolant tube from the inner cover to a tube in the outer cover.

Preferably, the tubes and spray nozzle means could be secured to the top wall of the inner cover so that upon removal of the top wall from the inner cover, all the tubes and spray nozzle means would be removed with the top wall leaving only the bottom wall and upstanding wall of the inner cover. Since the bottom wall is subjected to the heat from within the vessel, it is usually subjected to wear and cracking from cyclic thermal exposure to the heat. Thus by securing the tubes and spray nozzle means to the top wall of the inner cover, the removal of the top wall will expose the bottom wall for easy inspection and the performance of any maintenance, if required.

In another preferred embodiment of the invention, the inner cover would define three openings in the inner cover to accommodate electrodes which could be fed into the vessel as would be required in an electric arc furnace. Each opening would be defined by an upstanding wall that would terminate at the bottom wall while the top wall would have a similar open arrangement so that when the top wall was assembled over the bottom wall, the openings would extend through both the top wall and the bottom wall. The upstanding wall defining the openings would prevent any of the coolant from entering the enclosed space of the inner wall. If desired, the spray nozzles in addition to being directed against the bottom wall could also be directed against the upstanding wall defining the openings in the inner cover. This would insure that not only would the bottom wall be cooled but also the upstanding walls could be cooled by the sprayed coolant.

In an operating furnace of this invention, the inner cover could easily be removed for inspection and maintenance without disturbing the outer cover. Since the inner cover could generally require more maintenance, the removable feature of a spray cooled inner cover will effectively provide the benefit of spray cooling for the inner cover with the added feature of having the inner cover easily removable for inspection and if necessary, repairs which could be performed effectively and efficiently.

The preferred embodiment of the invention is utilized as an inner cover or delta for a furnace roof of a metallurgical vessel, for example, an electric arc furnace. The under side of the bottom or inner wall of the cover could include projections from the bottom which extend into the interior of the furnace to trap and retain solidified portions of molten material, for example, spattered slag, which contact the roof underside to provide a more adherent in-situ formed, thermally insulating lining which reduces thermal shock to the roof. By properly forming an in-situ lining of insulating slag on the underside of the inner wall and securing such slag to said undersurface of the inner wall, the roof can be removed for charging or the like and positioned back on the furnace without loss of the insulating slag liner. This will protect the bottom wall from exposure to large temperature variation and thereby effectively minimize thermal shock which could result in stress cracking of the inner wall. The use of hollow tubular projections can trap the spattered slag in and around the tubular projections so as to provide an anchor for the slag lining that will then remain secured to the undersurface of the bottom wall of the cover even when the full cover is moved.

When water is used as the coolant, the system of the invention is highly efficient, using significantly less cooling water than water flooded systems. For instance, in one example using the system of the invention, only about one half as much coolant is used as in a typical prior art water flooded system. This significant reduction in the amount of coolant water required is particularly important for some metal producers who do not have an adequate water supply necessary for the water cooled systems currently available. Moreover, the scrubbing action of the sprays against the working plates keeps the plate surface clean, thereby enhancing cooling efficiency and prolonging the life of the furnace and/or components. In some prior art systems, scale and sludge tend to build up either in pipes or within the enclosed fabrication, requiring frequent cleaning or chemical treatment of the water in order to maintain efficient cooling.

The coolant fluid is preferably water or a water base fluid, and is sprayed in a quantity such that the spray droplets absorb heat due to surface area contact. If desired, thermocouples could be embedded in the plates to measure the temperature and these thermocouples could be connected with suitable controls to adjust the rate of coolant flow to maintain the desired temperature. The droplets of coolant fluid produced by the spray system contact a very large surface area, resulting in a large cooling capacity and the water is removed in the liquid form. However, although the temperature of the coolant fluid (water) normally does not reach 212° F., if it does reach such temperature due to the occurrence of a temporary hot spot, or the like, it flashes, whereby the latent heat of vaporization of the coolant is used in cooling the working plates, resulting in a calorie removal approximately ten times that which can be achieved with flood cooling.

Significantly less maintenance is required with a spray cooling system than is required with prior art water flooded systems. For instance, if the water temperature exceeds about 140° F. in a prior art water flooded system, precipitates will settle out, causing scaling and buildup on the surface to be cooled, reducing cooling efficiency. Further, if the water temperature exceeds about 212° F. in a prior art system, steam can be generated, creating a dangerous situation with the possibility of explosion. As noted previously, the sprays of water have a scrubbing effect on the surface being cooled, tending to keep it clean of scale, etc. Moreover, the system of the invention can be used with sufficient pressure to effect a spray, and access to the cooling space is convenient, enabling easy cleaning or repair when necessary. Water flooded systems, on the other hand, comprise individual panels which must be removed and flushed to preserve their life. Also, water flooded systems require a substantial number of hoses, pipes, valves and the like to connect and disconnect and maintain.

As stated above, the removable feature of a spray cooled inner cover will permit easy access to the inner cover for inspection and repair. As also stated above, in the preferred embodiment, the tubes and spray nozzle means could be secured to the upper wall so that they could easily be removed from the inner cover for inspection while at the same time exposing the bottom wall and upstanding walls for inspection. Thus any repairs needed to the bottom wall and/or upstanding walls could be easily and effectively made. Once repairs are made, the top wall with the attached tubes and spray nozzles could easily be positioned over the bottom wall so as to complete the assembly of the inner cover. The coolant inlet means of the inner cover could be coupled to the inlet tube and the outlet spent coolant means of the inner cover could be coupled to a discharge tube for removing the spent coolant. As stated above, when the outer cover is also equipped with spray coolant means, the coolant feed into the outer cover could also be fed into the inner cover, and the spent coolant could be fed through a tube on or in the outer cover and discharged at the peripheral area of the outer cover.

DETAILED DESCRIPTION OF THE INVENTION

Figure 1:
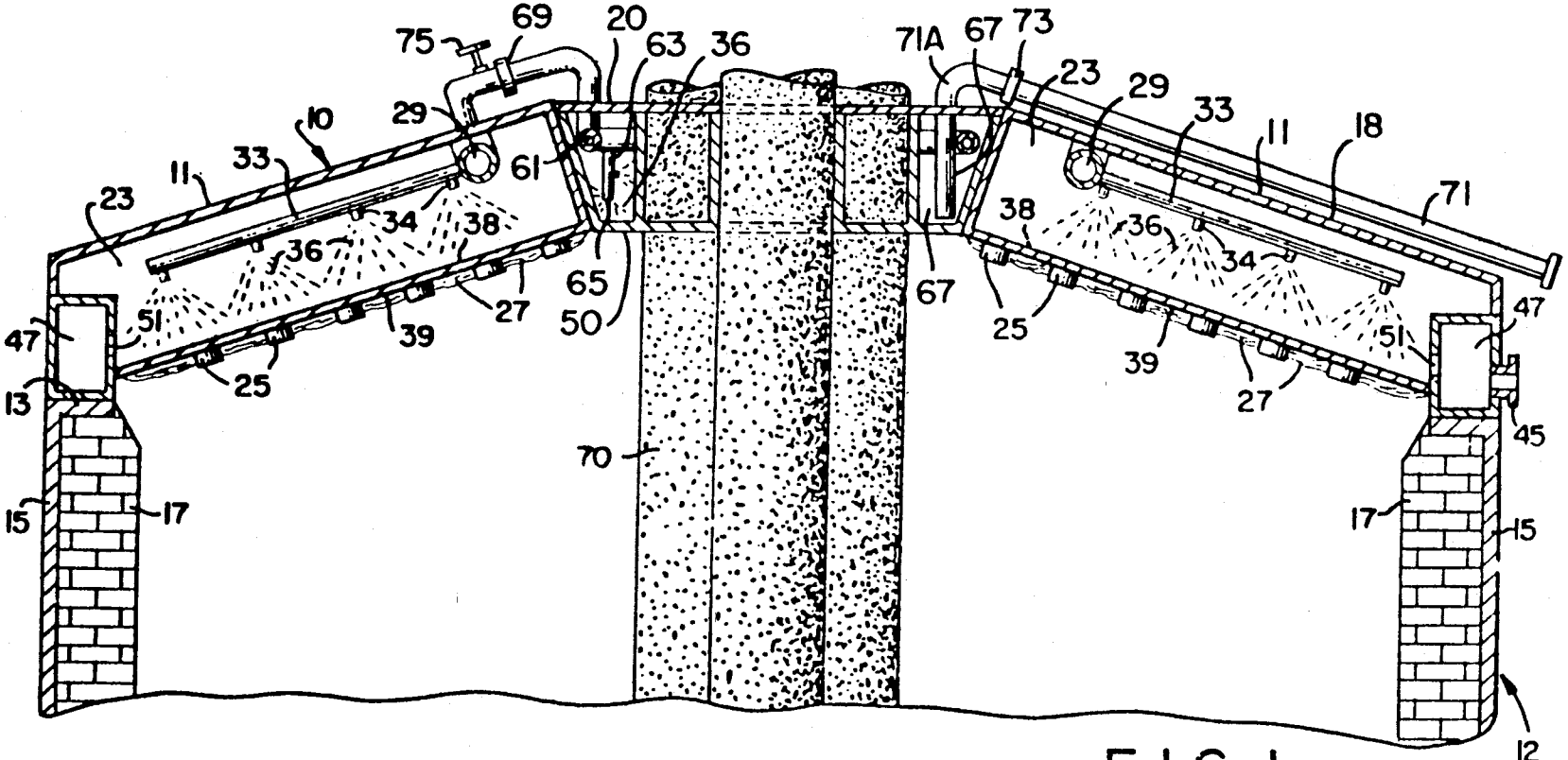
FIG. 1 is a cross-sectional side view of the upper portion of an electric arc furnace cover embodying the present invention.

As used herein, vessels shall mean containers for handling heated substances such as vessels for handling molten materials, hot gases or liquids, or the like. The preferred embodiment of the present invention is shown in the drawings wherein there is shown an electric arc furnace and associated roof structure. Like numerals are used to identify like features throughout the figures.

Figure 2:
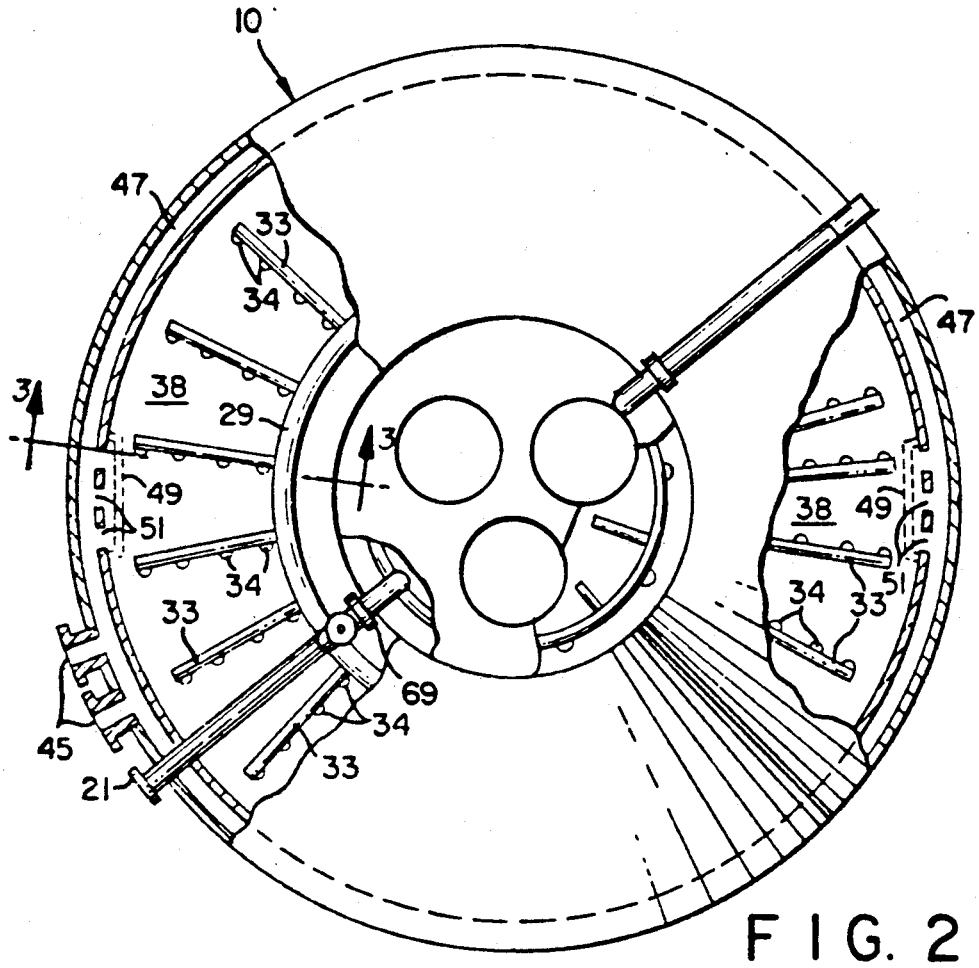
FIG. 2 is a plan view of an electric arc furnace cover of the present invention, partially cut-away and partially in section, showing the interior of the furnace cover.
Figure 3:
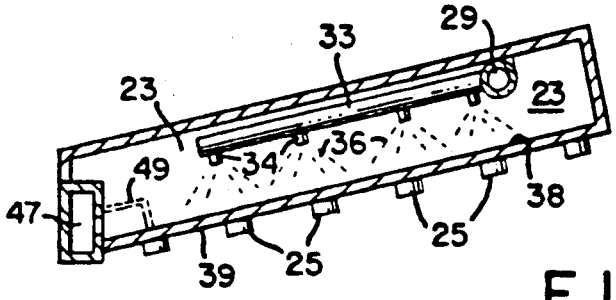
FIG. 3 is a side elevational view of the portion of the furnace cover along lines 3—3 of FIG. 2.

A preferred embodiment of the fluid cooled containment means of the present invention is shown in FIGS. 1 and 2. In this embodiment, the containment means comprises a circular electric arc furnace roof 10, shown in cross-section, sitting atop a typical electrical arc furnace 12. The portion of furnace 12 just below rim 13 consists of a steel furnace shell 15 lined by refractory brick 17 or other thermally insulating material. The furnace side wall above the melt line alternatively may be constructed, of inner and outer plates utilizing the internal spray cool system described below in conjunction with roof 10. The furnace roof comprises an outer cover 18 and inner cover 20. The outer cover 18 comprises a hollow interior section 23 between top wall 11 and bottom wall 39.

Figure 6:
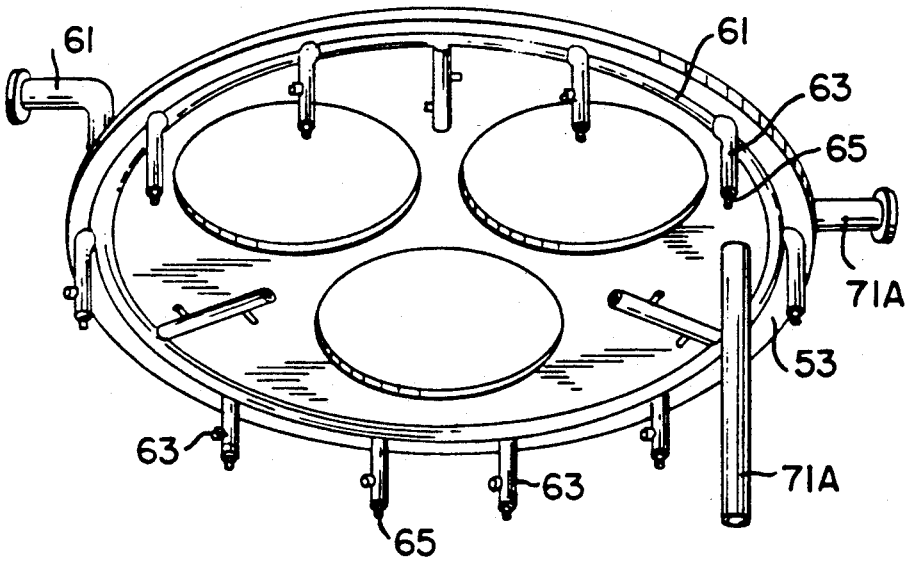
FIG. 6 is a perspective view, looking underneath the top wall of the inner cover or delta of this invention showing tubes and spray nozzles secured to the top wall.
Figure 5:
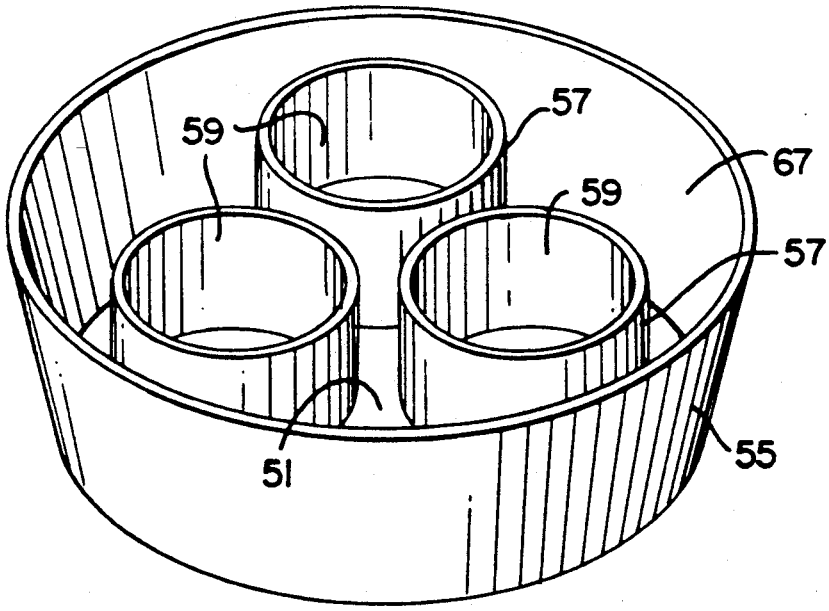
FIG. 5 is a perspective view, looking down, on the bottom wall and upstanding walls of the inner cover or delta of this invention.

Within this interior space 23 there is a plurality of spoke-like cooling spray nozzles 33 which receive coolant from a central concentric ring-shaped water supply manifold 29. Downward extending spray heads 34 spray the coolant 36 against the inside 38 of cover bottom 39 to maintain the roof at an acceptable temperature during melting or other treating of molten material in furnace 12. Coolant is removed from the roof interior via openings 51 in drain manifold 47 which extends around the lower outer periphery of the outer cover 18. Outlet 45 may be connected to an external drain line and permits draining of the coolant from manifold 47. Inner cover or delta 20 as shown in FIGS. 5 and 6 comprises a bottom wall 51, top wall 53 and upstanding wall 55. Three upstanding walls 57 define openings 59 for accommodating electrodes 70 as shown in FIG. 1. Top wall 53, as shown in FIG. 6, has secured to it a ring-shaped coolant supply manifold 61 having extended spoke-like cooling tubes 63 coupled to spray nozzles 65 which direct coolant 36 against the bottom wall 51 in space 67. If desired, the coolant 36 could also be directed against upstanding walls 57. As shown in FIGS. 1 and 2 coolant 36 is supplied from inlet 21 which communicates with spray manifold 29 in space 23 of outer cover 18 and to spray manifold 61 in space 67 in inner cover 20. Coupling member 69 is used to couple the outlet of tube 21 to the inlet of spray manifold 61. Spent coolant in the inner cover 20 is removed by suction through tube or hose 71 which extends on top of outer cover 18. In the preferred embodiment as shown, tube 71A would extend into the inner cover 20 to remove the spent coolant and terminate just above the upper outer wall 53 and then using conventional coupling means 73 the tube 71A would be secured to tube 71 which in turn would be extended to the periphery of the outer cover 18. Conventional suction means would then be coupled to the outlet of tube 71 for removing the spent coolant from the space 67 in inner cover 20. If desired, tube 71 could be secured to the outer top surface 11 of outer cover 18. Thus the inner cover 20 could be easily removed by separating the spray manifold 61 from inlet 21 via coupling member 69 and separating tube 71 from tube 71A via coupling member 73 and then removing the inner cover 20 from roof 10. If desired, inner cover 20 could have its own coolant supply means independent of outer cover 18. Although the coolant supply manifold 61, extended spoke-like cooling tubes 63 and nozzles 65 are secured to top wall 53 in the preferred embodiment, these components could be secured to the upstanding wall and/or bottom wall, if desired. These spray components could also rest on the bottom wall without being secured to any of the walls.

Figure 4:
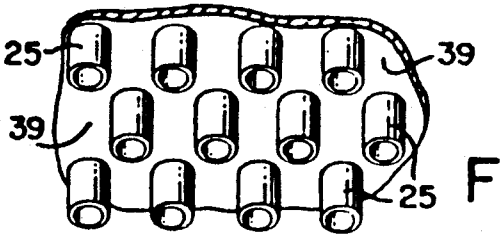
FIG. 4 is a perspective view of a portion of the underside of the furnace cover of FIG. 2.

During operation of furnace 12 in steel making, for example, the molten steel will be covered by molten slag or other protective material which tends to splash or spatter in various directions. As such spattered slag contacts the underside 39 of outer cover 18, portions will tend to solidify and adhere to the underside of the cover. When solidified, this slag acts as a thermally insulating layer which tends to lower the temperature of that portion of the roof which it covers. During normal operation of the furnace and roof assembly, the slag may tend to spall off at times, for example, when the roof is removed or otherwise when the roof underside is subject to cycling between hot and relatively cool temperatures. This same temperature cycling may occur, but to a lesser degree, when electric power to the electrodes is interrupted for furnace shutdown. As a consequence of this, the underside 39 of the outer cover 18 which is normally made of steel plate or the like, is subject to thermal shock and stress which tends to create metal fatigue and ultimate cracking of the steel plates. To more securely trap and retain slag on the underside of outer cover 18 and to reduce the chance of spalling during thermal cycling or during removal of the outer cover from the furnace, a plurality of projections 25 (i.e., tubular or arcuate projections) cover the roof underside 39. These projections 25 as shown in FIG. 4 are welded to the entire inner surface of the roof at spaced intervals and act as slag retention cups or sleeves. Slag spattering up from the melt will tend to form in situ an adherent thermally insulating refractory lining 27 around and within projections 25, as shown in FIG. 1. It should be noted that this lining 27 is not necessary for steady state temperature control of the roof underside 39, as the spray cooling system performs this task well. However, because of its usual formation, the present invention provides for the slag lining 27 to be made more adherent by the embedded projections 25 and consequently the roof is less subject to undesirable thermal stress. As shown in the drawings, coolant 36 is supplied to manifold 29 of outer cover 18 and fed to spray nozzles 34. The coolant 36 is directed onto bottom wall 38 to cool bottom wall 38. The coolant is preferably water or a waterbased liquid To remove the coolant after it is sprayed onto the inside of wall 38, there is provided a draining or evacuation system comprising drain manifold 47 which extends around the periphery of the interior of outer cover 18 Drain manifold 47 is shown made of rectangular tubing, and utilizes elongated slots 51 or other spaced openings along the lower inner facing wall portion which receive the spent coolant from the slanted lower wall 38. Spent coolant should be drained as quickly as possible so that there is a minimum of standing coolant over the lower wall 38 to minimize interference with the spray of coolant directly against wall 38. All of the manifold openings or coolant outlets 51 will preferably be covered by screen 49 to prevent debris from entering the manifold and blocking the removal of coolant. Coolant is then removed via discharge outlet 45 (FIG. 2) from the respective sections of manifold 47. To quickly remove the spent coolant 36 from the interior of outer cover 18, vacuum or pump means may be employed.

In a similar manner, coolant 36 is supplied to manifold 61 of inner cover 20 and fed to spray nozzles 65. As shown in FIG. 1, a supply of coolant for the outer cover 18 could also be used for supplying coolant to the inner cover 20. An on-off valve 75 is positioned near the end of tube 21 and the outlet of tube 21 is connected to the input of manifold 61 by coupler 69 so that the coolant is supplied from the same source for both the inner cover 18 and outer cover 20. To remove spent coolant from inner cover 20, a tube 71A is extended into the enclosed space 67 at one end and projected above the top wall 53 where it is connected to tube 71 by coupler 73. To insure quick removal of the spent coolant from the interior of inner cover 20, tube 71 could be connected to vacuum means or pump means. By disconnecting couplers 69 and 73, inner cover 20 could be easily removed.

Thus, the present invention provides for simple, high efficiency cooling for the inner surface of various types of closed-bottom vessels such as the arc furnace shown in the drawings, as well as other types of melt furnaces, ladles, and the like. Additionally, the relatively low pressure in the containment means interior minimizes the risk of coolant leakage into the vessel. The present invention provides such cooling efficiency that it is generally unnecessary to install any type of refractory or other thermal insulation along the bottom walls 39 and 50 of the containment means, although it may be desirable to place some type of thin coating thereon as protection from the corrosive nature of the hot gases that may be generated in the vessel interior. Although not needed for thermal insulation per se, the hollow tubular projections 25 can retain any spattered slag or other material thus providing an adherent protective barrier which is formed in situ which will prolong vessel life through the reduction of thermal stress to the inner wall of the containment means.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

What is claimed:

1. A cover for a vessel for handling a heated substance, said cover comprising an outer cover defining an inner opening into which is seated a removable inner cover, said outer cover comprising a bottom wall, an upstanding peripheral wall, an upstanding inner wall and a top wall defining an enclosed space, and said upstanding inner wall defining said inner opening into which said removable inner cover is seated; spray means comprising a plurality of tubes coupled to spray nozzles disposed within said enclosed space of the outer cover; inlet means for bringing a coolant to the tubes and spray nozzles in said enclosed space of the outer cover with the spray nozzles arranged to direct a spray of coolant onto at least the bottom wall of the outer cover; outlet means for removing the coolant from the enclosed space of the outer cover; said inner cover comprising a bottom wall, an upstanding wall and a top wall defining an enclosed space for said inner cover; spray means comprising a plurality of tubes coupled to spray nozzles disposed within said enclosed spaced of said inner cover and secured to the top wall; inlet means for bringing a coolant to the tubes and spray nozzles in the inner cover and said spray nozzles arranged to direct a spray of coolant onto at least the bottom wall of the inner cover; outlet means for removing the coolant from the enclosed space in the inner cover; and said inner cover defining at least one opening by a separate upstanding wall extended from the bottom wall to the top wall so that coolant in the enclosed space is prevented from entering said at least one opening in said inner cover.

2. The cover of claim 1 wherein the inlet means of the outer cover are coupled to the inlet means of the inner cover.

3. The cover of claim 2 wherein the outlet means of the inner cover comprises a tube extending from the enclosed space of the inner cover out through the top wall of the inner cover and over the top wall of the outer cover.

4. The cover of claim 2 wherein said spray nozzles int eh inner cover are arranged to direct a spray of coolant also onto at least a portion of one of the upstanding walls of said inner cover.

5. The cover of claim 1 wherein pump means are coupled to the output means of the inner cover for forceably removing the coolant from the inner cover.

6. The cover of claim 5 wherein pump means are coupled to the output means of the outer cover for forceably removing the coolant from the inner cover.

7. The cover of claim 2 wherein pump means are coupled to the output means of the inner cover for forceably removing the coolant from the inner cover and wherein said pump means are coupled to the output means of the outer cover for forceably removing the coolant from the inner cover.

8. The cover of claim 1 wherein said inner cover has at least three openings defined by three separate upstanding walls.

9. A cover for a vessel for handling a heated substance, said cover comprising an outer cover defining an inner opening into which is seated a removable inner cover, said outer cover comprising a bottom wall, an upstanding peripheral wall, an upstanding inner wall and a top wall defining an enclosed space, and said upstanding inner wall defining said inner opening into which said removable inner cover is seated; spray means comprising a plurality of tubes coupled to spray nozzles disposed within said enclosed space of the outer cover; inlet means for bringing a coolant to the tubes and spray nozzles in said enclosed space of the outer cover with the spray nozzles arranged to direct a spray of coolant onto at least the bottom wall of the outer cover; outlet means for removing the coolant from the enclosed space of the outer cover; said inner cover comprising a bottom wall, an upstanding wall and a top wall defining an enclosed space from said inner cover; spray means comprising a plurality of tubes coupled to spray nozzles disposed within said enclosed space of said inner cover; inlet means for bringing a coolant to the tubes and spray nozzles in the inner cover and said spray nozzles arranged to direct a spray of coolant onto at least the bottom wall of the inner cover; outlet means for removing the coolant from the enclosed space in the inner cover; said inner cover defining at least one opening by a separate upstanding wall extended from the bottom wall to the top wall so that coolant in the enclosed space is prevented from entering said at least one opening in said inner cover, said inlet means of the outer cover are connected to the inlet means of the inner cover by coupling means and wherein the outlet means of the inner cover comprises a first tube extending from the enclosed space of the inner cover out through the top wall of the inner cover; a second tube having an inlet end and an outlet end and extending over the outer cover; said inlet end of the second tube is connected to the first tube extending from the inner cover by coupling means so that said first tube can be disconnected or connected to the second tube.

10. The cover of claim 9 wherein the second tube is secured to the top wall of the outer cover.

* * * * *